United States Patent [19]

Sato

[11] Patent Number: 5,049,228

[45] Date of Patent: Sep. 17, 1991

[54] DESK TOP TYPE LABEL PRINTER

[75] Inventor: Junichi Sato, Hasudashi, Japan

[73] Assignee: Kabushiki Kaisha Shinsei Industries, Tokyo, Japan

[21] Appl. No.: 401,134

[22] Filed: Aug. 30, 1989

[30] Foreign Application Priority Data

Sep. 2, 1988 [JP] Japan ..... 63-220092

[51] Int. Cl.[5] ..... B41M 3/00

[52] U.S. Cl. ..... 156/384; 156/361; 400/208

[58] Field of Search ..... 400/120 HPC, 208, 611; 101/288; 156/361, 384

[56] References Cited

U.S. PATENT DOCUMENTS

| | | | |
|---|---|---|---|
| 4,262,591 | 4/1981 | Cook . | |
| 4,264,396 | 4/1981 | Stewart | 156/361 |
| 4,776,714 | 10/1988 | Sugiura et al. | 400/208 |
| 4,826,558 | 5/1989 | Wada et al. | 156/384 |

FOREIGN PATENT DOCUMENTS

| | | | |
|---|---|---|---|
| 0120455 | 3/1984 | European Pat. Off. . | |
| 0297568 | 1/1989 | European Pat. Off. . | |
| 63-45073 | 2/1988 | Japan | 101/288 |
| 63-49467 | 3/1988 | Japan | 156/384 |

*Primary Examiner*—David A. Simmons
*Assistant Examiner*—Robert Barker
*Attorney, Agent, or Firm*—Wenderoth, Lind & Ponack

[57] ABSTRACT

A desk top type label printer in which a thermal printing head unit having a thermal printing head and a tape depressing mechanism arranged opposed to the thermal printing head unit are provided inside a casing which is open at a lateral side where an openable cover is provided and the thermal printing head unit and tape depressing mechanism are respectively supported by shafts which protrude from the internal wall of the casing toward the opening side of the casing and have their opening side end as a free end, the tape depressing mechanism being pivoted on the associated shaft and provided with a platen roller at its turnable end so that the platen roller comes in contact under pressure with the thermal printing head whereby the tape depressing mechanism is engaged with and fixed to the supporting shaft for the thermal printing head unit.

8 Claims, 9 Drawing Sheets

DESK TOP TYPE LABEL PRINTER

BACKGROUND OF THE INVENTION

The present invention relates to a desk top type compact label printer.

The conventional label printers of this type are adapted to accommodate a label tape, which is made up by adhering a number of labels onto a carrier strip in order and winding the carrier strip in the shape of roll, extend said label tape below the printing head and print a required information onto each of these labels in sequence, as disclosed in U.S. Pat. No. 4,826,558.

Most printers of this type of label printer employ an electronic thermal printing head such as, for example, a thermographic printing head and the like to print a bar code on each of the labels.

In the label printers employing such electronic thermal printing head, said thermal printing head and the label depressing mechanism for making the label contact the thermal printing head are firmly supported at both ends to make each label accurately contact the thermal printing head and are located inside the casing.

Since the conventional label printers are constructed as described above, it is necessary for loading the label tape in the label printer to mount a roll of label tape on the tape holder, extend the label tape from this roll of label tape and pass the label tape through the tape guide inside the label printer in the lengthwise direction of the tape and therefore there has been a problem that the setting of the label tape is troublesome.

SUMMARY OF THE INVENTION

An object of the present invention is to provide a desk top type label printer which is adapted to allow insertion of a label tape between the thermal printing head and the platen roller from a lateral side of the printer. In the printer in accordance with the present invention, therefore, a supporting shaft and a fixed shaft, which are so-called cantilever type shafts, each of which protrudes toward the opening side of the casing and has the protruded end as a free end, are provided in a parallel arrangement in the casing which is open at its lateral side, and the thermal printing head unit having the thermal printing head is fixed to said supporting shaft and the tape depressing mechanism having the platen roller is pivotally secured to said fixed shaft.

Said tape depressing mechanism is constructed to turn around so that the platen roller engages with and disengages from said thermal printing head. When the platen roller recedes from the thermal printing head, a space into which the label tape can be inserted from a lateral side is formed between the thermal printing head and the platen roller and, when said platen roller comes in contact with the thermal printing head, the label tape is held by and between said platen roller and said thermal printing head.

Said tape depressing mechanism and thermal printing head unit are respectively provided with collaborately acting engaging means to engage the tape depressing mechanism with the supporting shaft for the thermal printing head unit when the platen roller contacts the thermal printing head under pressure, thereby the tape depressing mechanism is engaged with the thermal printing head unit.

For improving the engaging effect of the tape depressing mechanism in the label printer in accordance with the present invention, such label printer is provided with a pair of engaging parts in the shape of partly cutaway circle which act said engaging means on the supporting shaft of the thermal printing head unit and are respectively accommodated in a pair of engaging cutaway parts provided at the tape depressing mechanism so that the tape depressing mechanism is forced to engage with the supporting shaft when said pair of engaging parts are turned around in said pair of engaging cutaway, parts.

Said engaging parts are respectively provided at both sides of said thermal printing head and the section of each engaging part has a shape made up by partly cutting away a true circle with its center on the axial line of said supporting shaft and said engaging cutaway parts are provided at both sides of said platen roller opposed to said engaging parts and respectively have a straight passage which is open at the engaging part side and a circular part which is formed at a more inside position than said straight passage, and the width of said straight passage is made to be slightly larger than the thickness of each engaging part and the diameter of said circular part is made to be substantially equal to the diameter of said engaging part.

said engaging parts are constructed to be rotated by a knob provided on the supporting shaft and, when the engaging parts are turned in the engaging cutaway parts, the tape depressing mechanism is engaged with the thermal printing head unit and fixed to the supporting shaft. Accordingly, in this construction, the tape depressing mechanism are fixed to the supporting shaft of the thermal printing head unit and the platen roller is integrally assembled with the thermal printing head, thus making it possible to maintain a satisfactory cooperative relationship of both components.

Another object of the present invention is to provide a desk top type label printer capable of alternatively using labels made of thermosensing paper or ordinary paper.

For this purpose, a cassette containing a thermal transfer carbon ribbon is remountably fitted to the casing of the label printer according to the present invention and transfer printing onto an ordinary paper label can be carried out by depressing the label tape together with said carbon ribbon overlapped on the label tape against the thermal printing head.

Said carbon ribbon is wound in the shape of a roll, accommodated in the cassette and taken up by the takeup reel in the cassette after it contacts with the thermal printing head. This takeup reel is driven by the same driving mechanism which simultaneously drives the platen roller for feeding the label tape.

Said cassette is constructed so that it can be set with the thermal printing head unit in the manner for accommodating said thermal printing head from the lateral side and therefore the cassette can be inserted into the casing from the lateral side.

Another further object of the present invention is to provide a label printer which can be used not only as a label printer but also as a label applying machine, that is, a labeler.

For this purpose, the turnback pin for turning back the carrier strip of the label tape is provided at the label tape ejection side of the platen roller of said tape depressing mechanism and each of the labels retained on the label tape is peeled and caused to protrude by this pin as in case of the conventional labelers.

When this label printer is thus used as a labeler, it is preferable to reversely feed the label tape an extremely small distance by reversely turning the platen roller through a specified angle after a label is stuck onto an article. With this operation, a gap need not be formed between adjacent labels continuously stuck in sequence onto the carrier strip and therefore the carrier strip can be effectively used.

DETAILED DESCRIPTION OF THE PREFERRED EMBODIMENT

Figure 1:
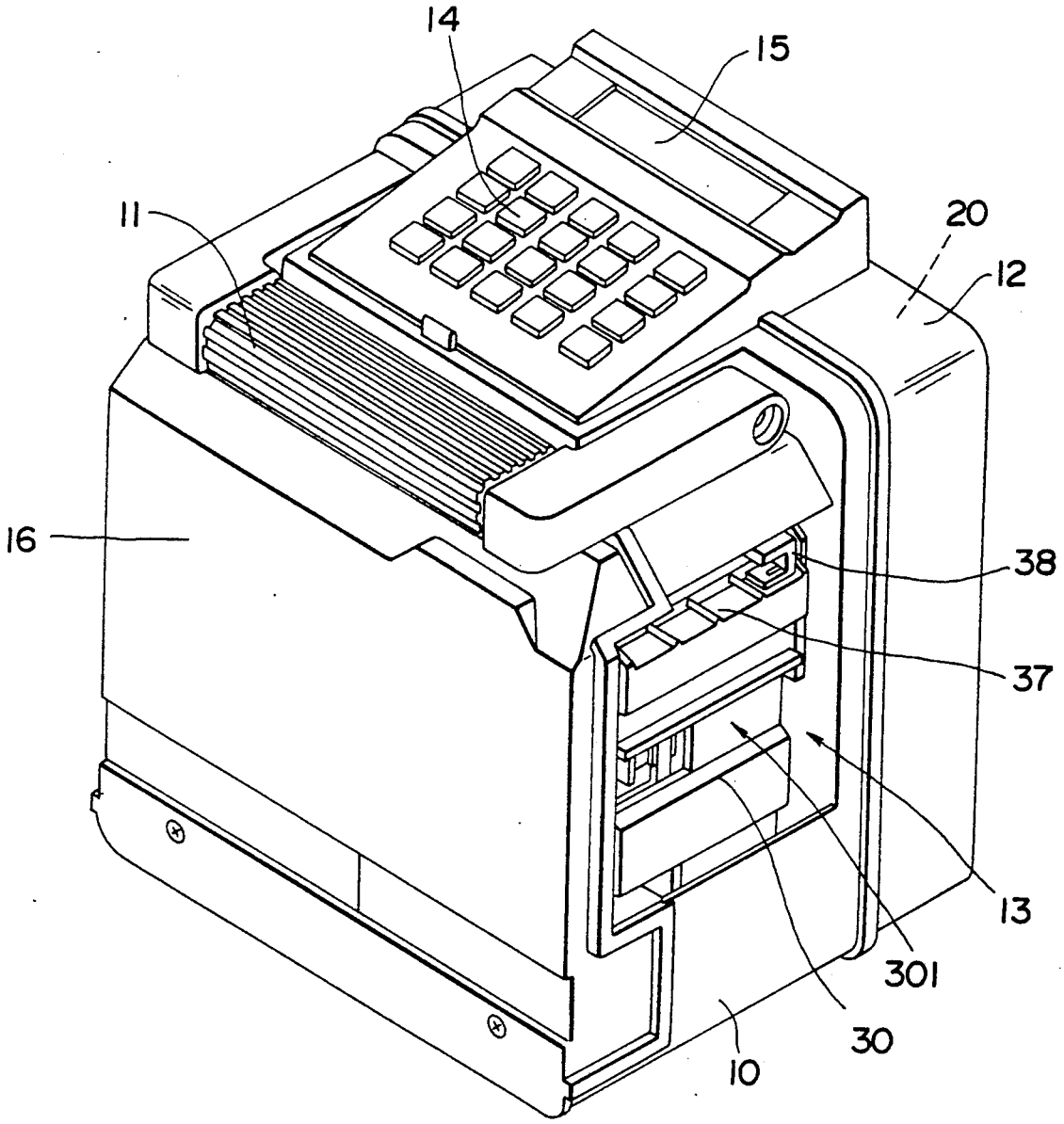
FIG. 1 is a perspective view of the label printer in accordance with the present invention.

The label printer according to the present invention is made to be portable, as shown in FIG. 1, by providing the handle 11 on the casing 10.

In said casing 10, the electric circuit part 12 incorporating the electric circuit 20 and the printing part 13 for feeding the label tape and printing labels are separately provided, and a ten key board 14 for entering the data into the electric circuit and the display unit 15 for displaying the input data are provided on the external surface of said casing 10.

An openable cover 16 is attached to the side of said printing part 13, which can be seen by opening said openable cover. 16.

The tape depressing mechanism 30 is provided behind the front face, that is, the surface at right angles to said openable cover 16, of said casing 10, that is tape depressing mechanism 30 is provided within the opening formed on the front face of the casing 10.

Figure 2:
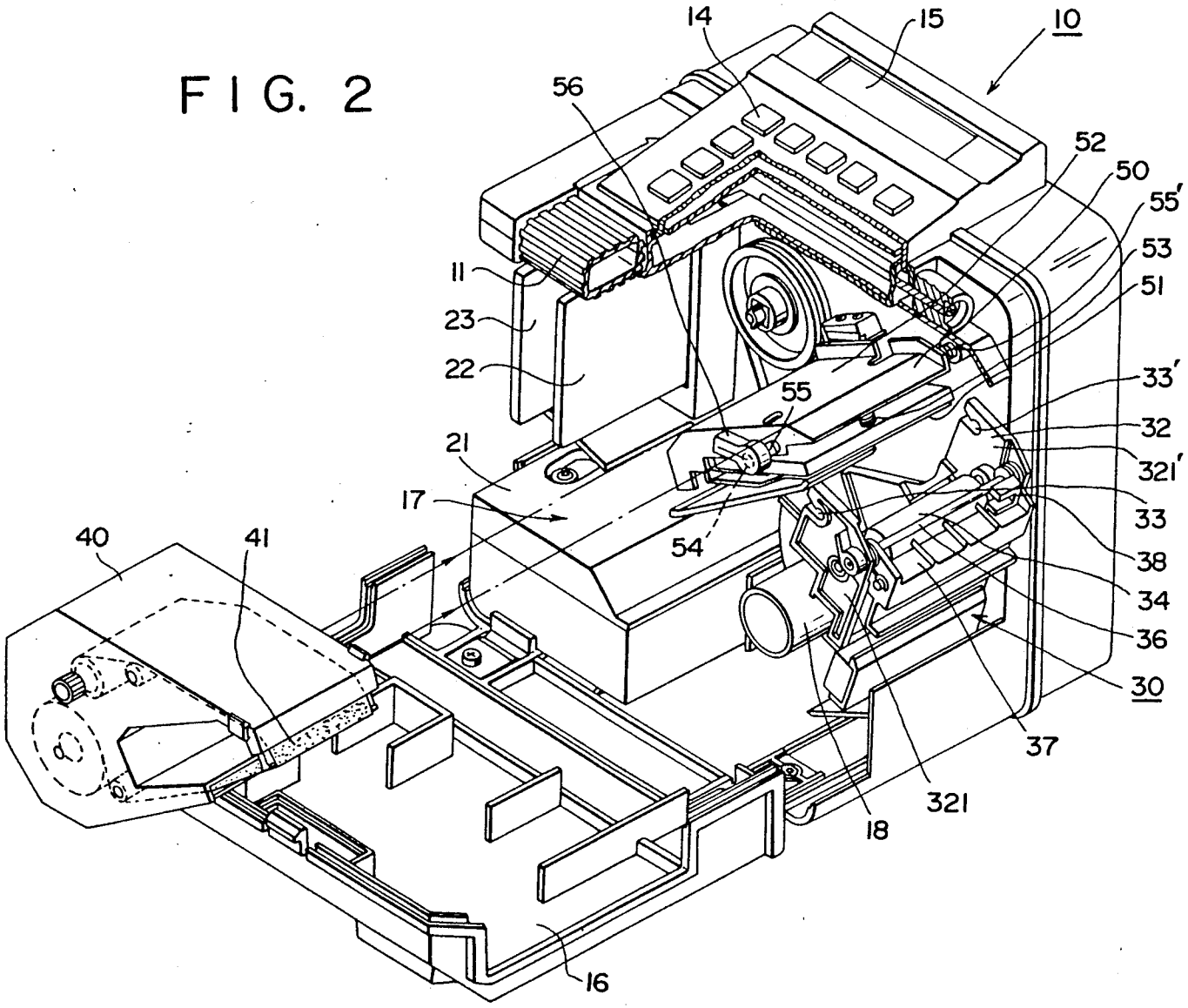
FIG. 2 is a partly cutaway perspective view showing the interior of said label printer.

In said casing 10, as shown in FIG. 2, the electric power supply 21 for operating said electric circuit 20, the ROM card 22 and RAM card 23, which are replaceably set to operate the microprocessor of the electric circuit 20, are accommodated, and the space 17 for accommodating a cassette 40 and the tape holder 18 for holding a roll of label tape are provided.

Figure 3:
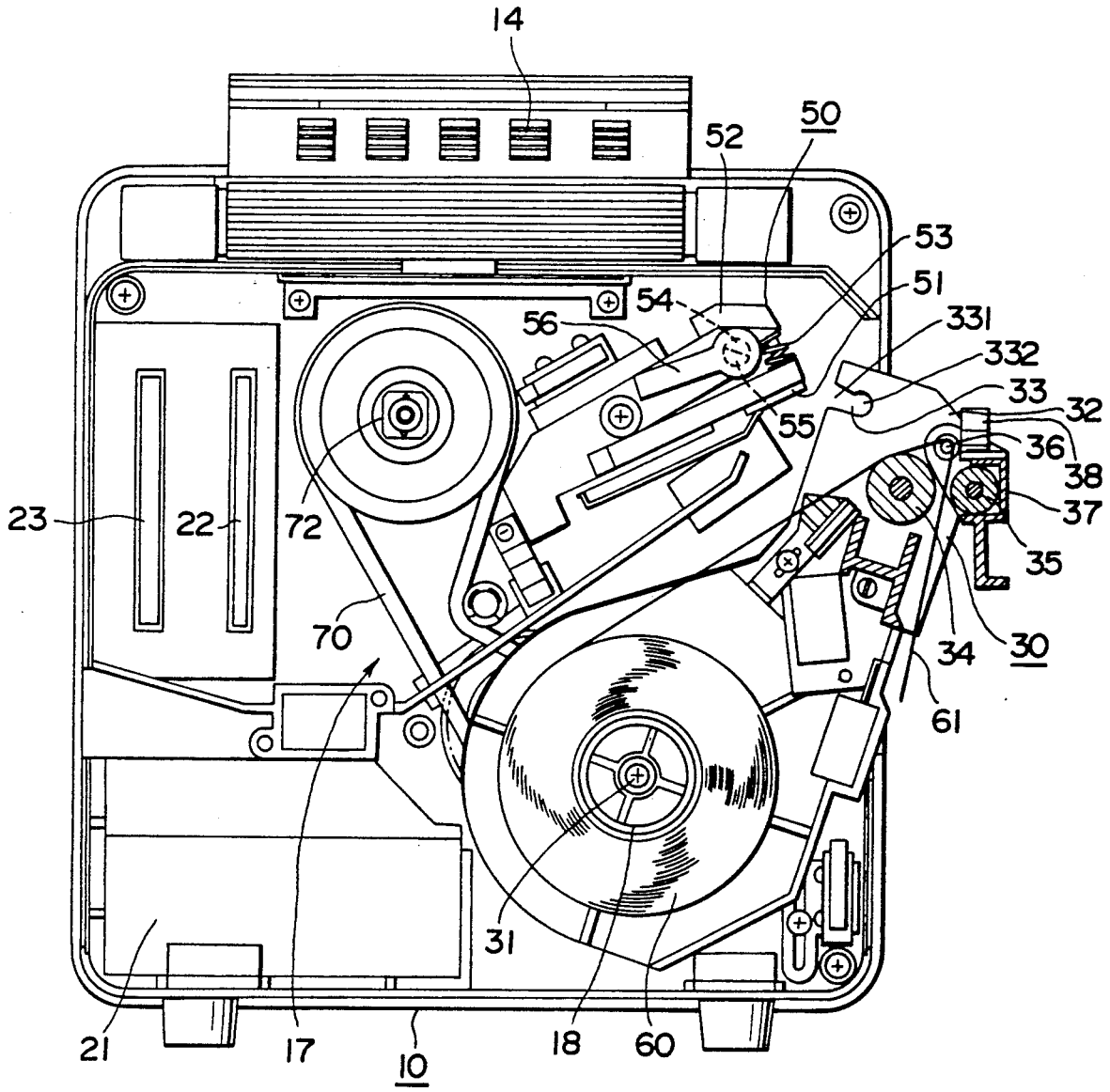
FIGS. 3 and 4 are side views showing the interior of said label printer and FIG. 3 shows the condition in which the tape depressing mechanism is kept separated and FIG. 4 shows the condition in which the tape depressing mechanism is coupled.

As shown in FIG. 2, said tape depressing mechanism 30 has the support frame 32 which is pivoted at its one side to the internal wall of the casing 10 on the fixed shaft 31 as shown in FIG. 3 and turned to the front and the back by such pivotal installation. Said support frame 32 is provided with a pair of frame plates 321 and 321' which are arranged in parallel to orthogonally intersect the axial line of the fixed shaft 31.

Said frame plates 321 and 321' are respectively provided with the engaging cutaway parts 33 and 33' as engaging means, which are formed, as shown in FIG. 3, by a straight passage 331 which is open at the front face of the turning side and a circular hole 332 which is provided at the inner part of said straight passage 331.

Figure 5:
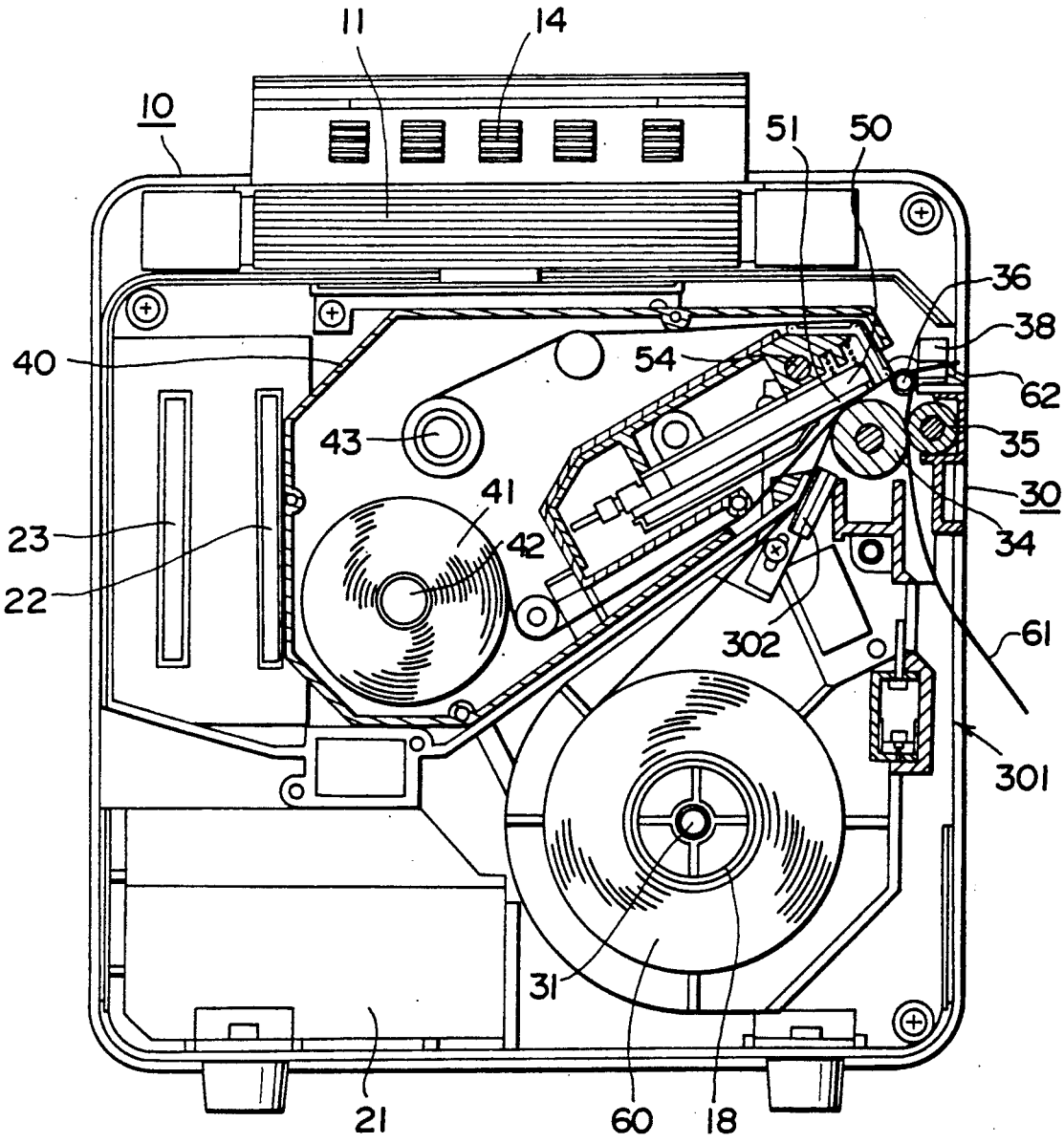
FIG. 5 is a partly cutaway side view showing the interior of said label printer in which the cassette is accommodated.

As shown in FIGS. 3 and 5, the platen roller 34, the feed roller 35 which relocatably contacts said platen roller 34 under pressure, the turnback pin 36 which is positioned above said platen roller 34 and said feed roller 35 and the label receiving member 37 located adjacent said feed roller 35 are provided between said frame plates 321 and 321', and the label sensor 38 is provided at an end of said label receiving member 37.

The thermal printing head unit 50 is arranged inside said casing 10 to oppose said tape depressing mechanism 30 and provided with the thermal printing head 51 such as, for example, a thermographic printing head, the base member 52 for supporting said thermal printing head 51, the spring 53 for pushing down the thermal printing head 51 around said base member 52 as a pivot and the shaft 54 which supports said base member 52.

Said shaft 54 is fixed at its one end to the internal wall of the casing 10 and its other end projects as a free end. This shaft 54 is located in parallel with said support frame 32, and the free end of the support frame 32 is opposed to the free end of the shaft 54.

Figure 7A:
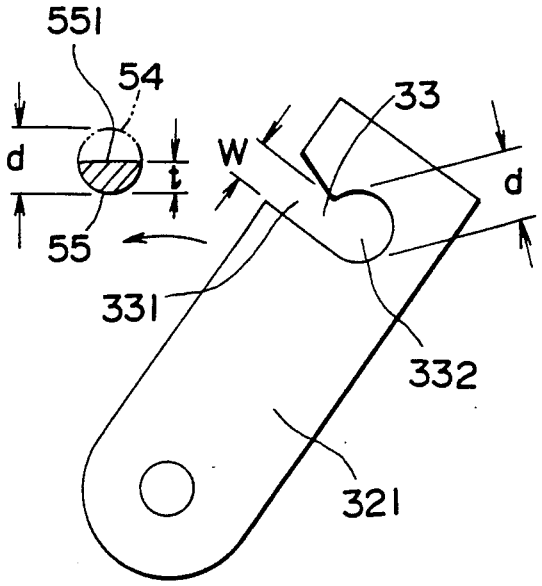
FIGS. 7A to 7C are respectively schematic views for explaining the engaging condition of the engaging parts and the engaging cutaway parts of said label printer.
Figure 7B:
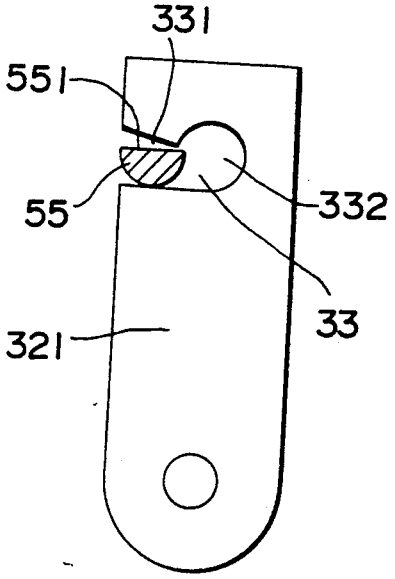

A pair of engaging parts 55 and 55' which serve as engaging means are provided on both end portions of said shaft 54 opposed to a pair of engaging cutaway parts 33 and 33' provided on the support frame 32 and said engaging parts 55 and 55' are formed as a shaft which has a cross section with a cutaway circular shape, for example, a semi-circular shape by partly cutting off the shaft 54. Said engaging parts 55 and 55', as shown in FIG. 7A, are formed to have a thickness t slightly smaller than the opening width W of the straight passage 331 of the engaging cutaway parts 33 and 33' and, accordingly, as shown in FIG. 7B, the engaging part 55 or 55' is smoothly inserted in the straight passage 331 of the engaging cutaway part 33 or 33' if said engaging part is laid down.

Figure 7C:
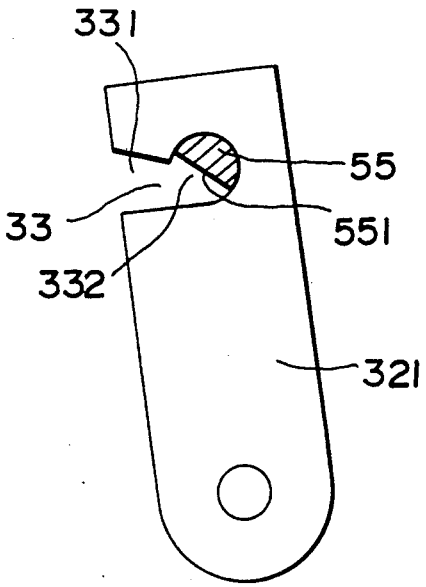

Said engaging part 55 or 55' can be turned after having been accommodated in the circular hole 332 of the engaging cutaway part 33 or 33' as shown in FIG. 7C. If the engaging part is turned as described above, it is blocked from passing through the entrance of the corresponding circular hole 332 by the cutaway surface 551 and the support frame 32 is thus firmly fixed to the shaft 54. Since said thermal printing head 51 is pushed by the platen roller 34 against the depression spring 53, the cutaway surface 551 of the engaging parts 55 and 55' is depressed into the circular holes 332 with a specified depressing force.

Figure 4:
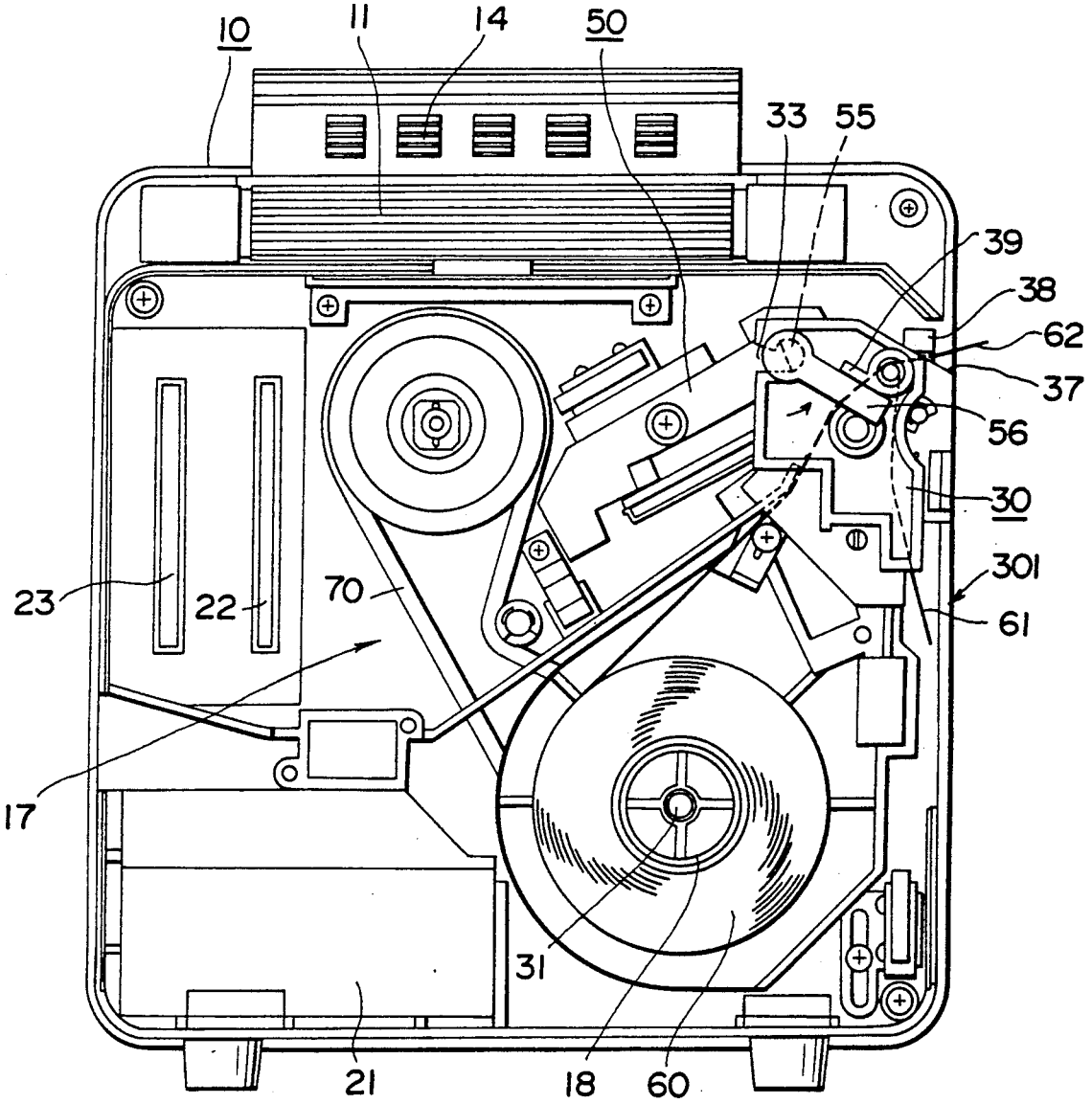

For turning said engaging parts 55 and 55', the knob 56 is provided on the free end of said shaft 54 and can be turned to a position where it contacts the stopper 39 at the support frame 32 as shown in FIG. 4. At this position, the cutaway surface 551 of the engaging parts 55 and 55' is blocked from passing through the entrance of the circular holes 332.

This engaging operation is made possible by the shape of engaging parts 55 and 55' and the shape of engaging cutaway parts 33 and 33'. The engaging parts 55 and 55' are formed in a shape of a true circle which is partly cut away so that the thickness t of the part with the cutaway surface is shorter than the diameter d of the true circle and the engaging cutaway parts 33 and 33' are formed so that the width W of the straight passage 331 is larger than the thickness t of the engaging parts and an expanded circular hole 332 which has substantially the same diameter as the diameter d of the true circle is provided in the inner part of said straight passage 331 to allow the engaging parts to engage in the circular holes 332 by turning the engaging part 55 in the circular hole 332. Since the engaging parts 55 and 55' are commonly made up by partly cutting off the shaft 54, the diameter d of the true circle is the same as the diameter of the shaft 54 but, depending on the case, a shaft-shaped part having a diameter differing from that of the shaft 54 may be provided on the shaft 54 as the engaging part.

Said cutaway surface 551 is engaged with the entrance of the corresponding circular hole 332, as shown in the embodiment, if the respective engaging part 55 55' is formed to have a semi-circular shaped section and the external periphery of the engaging part engages with the entrance of the circular hole 332 if the thickness t of the engaging part is similar to the diameter d of true circle.

A cassette 40 is remountably secured, as shown in FIG. 2, in said accommodating space 17 in said casing 10.

This cassette 40 contains a thermal transfer type carbon ribbon 41 and permits printing on common paper labels and therefore, if the cassette 40 is not used, thermosensing paper labels are used.

FIGS. 3 and 4 show the label printer in accordance with the present invention for which thermosensing paper labels are used. The label tape 60 is set on the tape holder 18 and extended keeping in contact with the thermal printing head 51, as shown in FIG. 4.

FIG. 5 shows the label printer in accordance with the present invention with the cassette 40 in place. The carbon ribbon 41 pulled out from the cassette 40 and the label tape 60 are overlapped at the platen roller 34 to receive heat from the printing head 51 from the carbon ribbon 41 side.

The cassette 40 is made in a shape to be laterally inserted around the thermal printing head 51 as shown in FIG. 5 and contains the winding reel 42 and the takeup reel 43 so that the carbon ribbon 41 is extended from the winding reel 42 and taken up by the takeup reel 43 after having contacted the thermal printing head 51.

Figure 6:
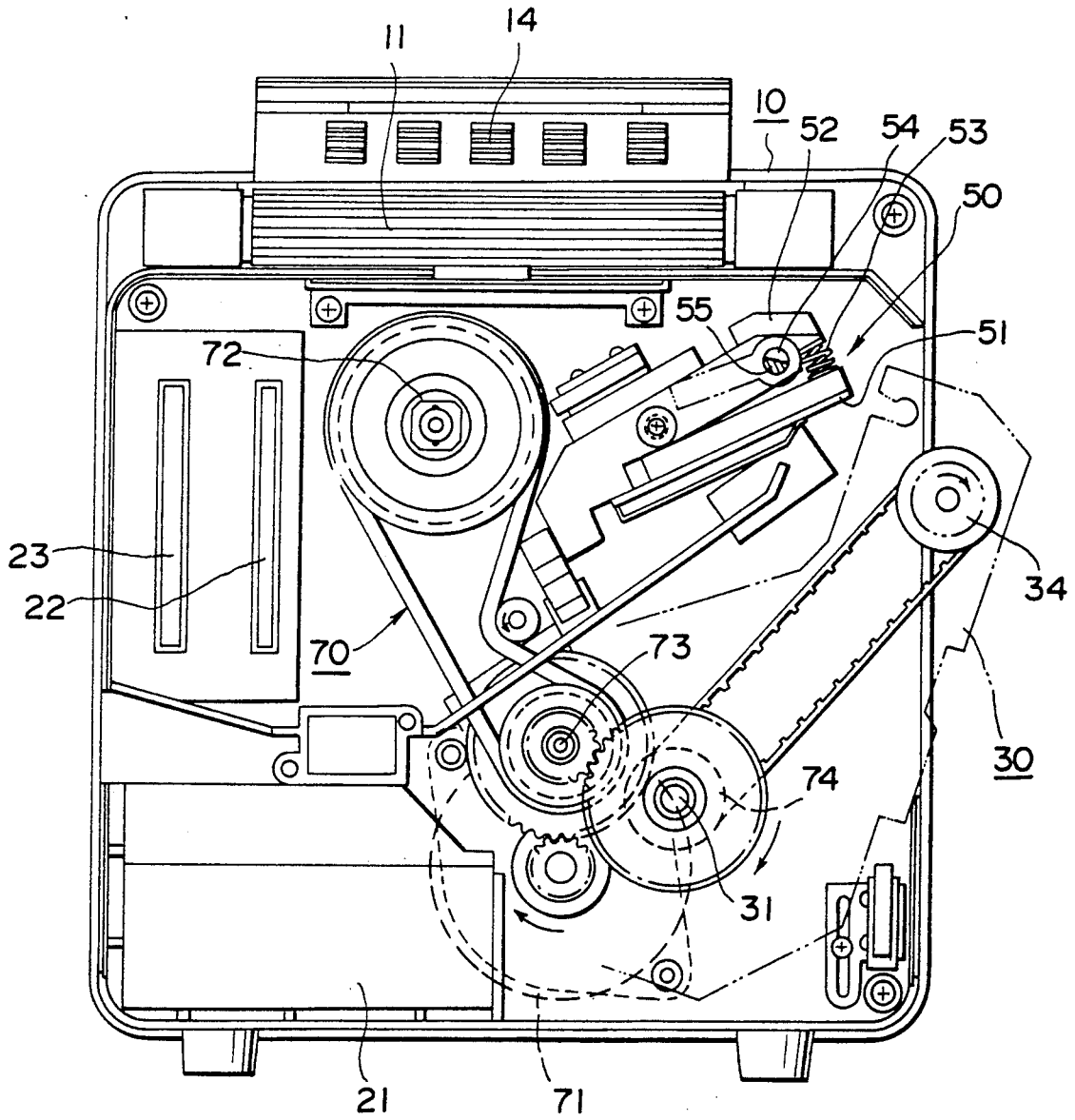
FIG. 6 is a side view showing the driving system of the label printer.

For this purpose, as shown in FIG. 6, a driving system 70 is provided in said casing 10 and has a reversible motor 71 housed in said electric circuit part 12 and two transmission systems which are driven by a motor 71. One of these transmission systems has the pulley 73 to drive the holding base 72 for the takeup reel 43 of said carbon ribbon 41 and the other has the pulley 74 pivoted on the fixed shaft 31 to rotate said platen roller 34.

In the embodiment, a battery cell or a rechargeable power pack is used as said power supply 21. Depending on the case, however, an external power supply such as, for example, a commercial power source can be used. In this case, said driving system 70 can be made with a different structure.

The label printer in accordance with the present invention can be used as a label applying machine or a labeler. In this case, the label tape 60 is fed intermittently.

Figure 8A:
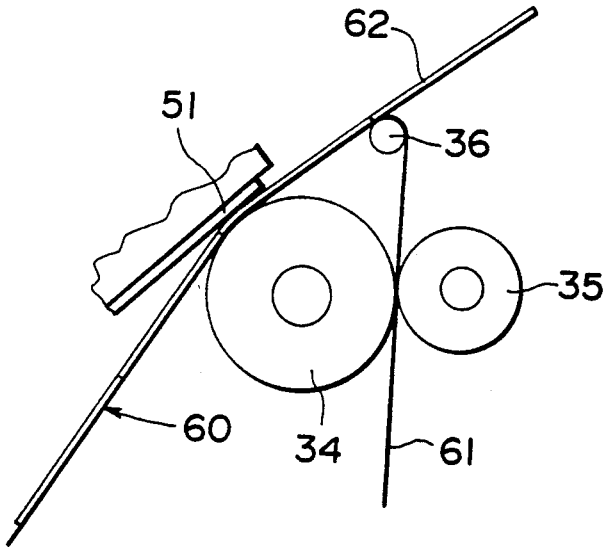
FIGS. 8A and 8B are respectively a brief illustration explaining the operating condition of said label printer.
Figure 8B:
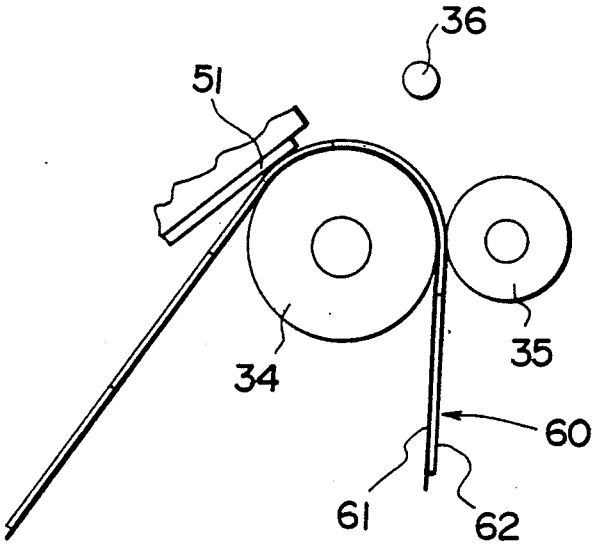

In case the label printer according to the present invention is used only for printing labels, the label tape 60 can be lowered along the platen roller 34 as shown in FIG. 8B and ejected from the ejection port 301 of the tape depressing mechanism 30. In this case, the label tape 60 does not pass over the turnback pin 36 and the carrier strip 61 and labels 62 are ejected as a label tape 60 without being separated.

A number of marks which are not shown are printed on the rear of said carrier strip so that these marks are detected by the sensor 302 provided on the tape depressing mechanism 30 opposed to the thermal printing head unit 50 and accordingly the feeding of the label tape 60 is controlled to control the position of the label 62 in reference to the thermal printing head 51.

Furthermore, if the label printer in accordance with the present invention is used as a labeler, the label tape 60 is turned back at the turnback pin 36 and inserted between the platen roller 34 and the feed roller 35 as shown in FIG. 8A.

In this case, a label 62 is peeled from the carrier strip 61 as the label tape 60 is fed intermittently and forwarded onto the label receiving member 37 and caused to protrude from said label receiving member 37 as shown in FIG. 4.

In this case, said label 62 is detected by the sensor 38 and the label tape will not be fed while the sensor 38 is detecting the presence of the label 62.

When a commodity is forced close to the label receiving member 37 of the tape depressing mechanism 30 and pushed up along the label printer while keeping the commodity depressed against the label 62 protruding from the label receiving member 37 and the label is thus stuck onto the commodity, the sensor 38 detects the absence of the label 62 and actuates the electric circuit 20 whereby the thermal printing head 51 again prints on the next label 62 on the label tape 60 and simultaneously the driving system 70 operates to cause this label 62 to protrude onto the label receiving member 37.

At this time, it is preferable to construct said platen roller 34 to reversely feed the label tape 60 prior to printing and return the leading label 62 to the printing start position of the thermal printing head 51.

Figure 9A:
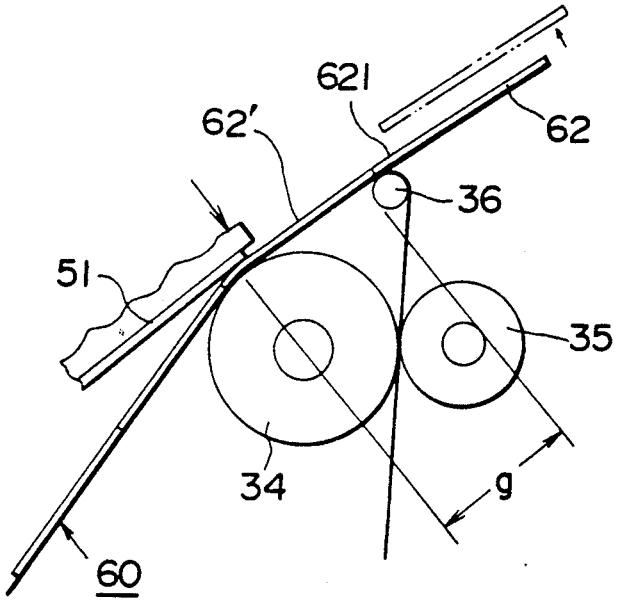
FIGS. 9A and 9B are respectively a brief illustration explaining the feeding of the label tape during a label sticking operation by said label printer.
Figure 9B:
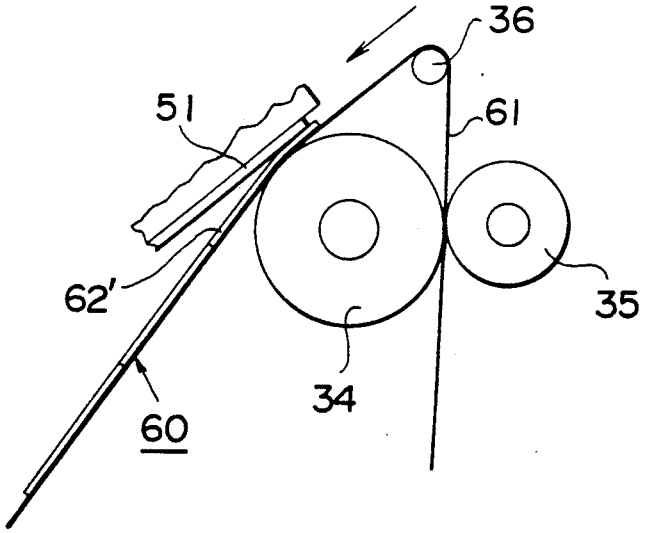

In other words, in this type of the labeler, the label 62 peeled from the carrier strip is held with its rear end 621 stuck to the carrier strip 61 as shown in FIG. 9A to maintain the label 62 protruded.

Accordingly, the label 62' following this peeled label 62 is deviated forward from the printing position of the thermal printing head 51 and cannot be printed at this position.

Conventionally, therefore, the labels 62 on said label tape 60 have been stuck slightly separated one from another on the carrier strip 61 to account for the gap g between the rear end 621 of said peeled label 62 and the thermal printing head 51 by a gap formed between labels 62 and 62', that is, a blank part where the carrier strip is exposed.

However, such method as described above causes a problem that it is necessary to form many blank parts on the label tape 60 and therefore the number of manufacturing processes is increased to cause the price to be increase and the number of labels 62 to be stuck to one label tape 60 is substantially reduced, thus making it economically wasteful.

In the label printer in accordance with the present invention, the label tape 60 retracts to the printing position, that is, the center line of the platen roller 34 prior to printing and such problem as described above is eliminated.

For this purpose, the printer according to the present invention is adapted so that the label tape 60 is fed slightly further even when the mark on the carrier strip 61 is detected by the sensor 302 and thus the leading label 62 is peeled from the carrier strip 61 and forwarded. Then, the motor 71 reversely rotates to reversely feed the label tape 60 and, when the sensor 302 detects the mark on said carrier strip 61, the label tape 60 is stopped so that the position where the label tape 60 is reversely fed and stopped is the starting point for printing by the thermal printing head 51.

In the above description, an input switch and a selector switch which are not shown are provided in this label printer.

The electric circuit 20 is driven by the input switch and two types of operation modes as shown in FIGS. 8A and 8B are alternatively selected by the selector switch.

Moreover, if said label tape 60 is reversely fed by the motor 71, only the label tape 60, or the label tape 60 and the carbon ribbon 41 are reversely fed to the rear side of the platen roller 34 and slackened. However, since the reverse feeding length of the label tape 60 is extremely short, the slackness of the label tape 60 will not hinder the operation of the label printer. The present invention is not limited to said embodiment and various modifications are available within a range which does not deviate from the spirit of the present invention.

What is claimed is:

1. A desk top type label printer comprising:

a casing having an opening at one side and having a laterally openable cover for said opening;

a tape holder for holding a roll of label tape in the interior of said casing;

a thermal printing head unit inside said casing and having a thermal printing head;

a tape depressing mechanism opposed to said thermal printing head unit and having a platen roller which is movable into and out of pressure contact with said thermal printing head;

a driving means for feeding label tape inserted between said thermal printing head and said platen roller out of said casing;

an electric circuit for controlling said thermal printing head and said driving means;

an input means for entering data to be printed in said thermal printing head unit through said electric circuit; and a supporting shaft for supporting said thermal printing head unit and having one end supported on the interior of said casing and the other end free and extending toward said opening;

said tape depressing mechanism having a support frame pivotally supported by a fixed shaft which extends parallel with said thermal printing head unit supporting shaft and having one end fixed to the interior of said casing and the other end a free end, said platen roller being at a free end of said support frame, and said thermal printing head unit and said tape depressing mechanism respectively having engaging means for engaging said tape depressing mechanism with said thermal printing head unit, said thermal printing head and said platen roller having a space therebetween which is open toward said opening for inserting a label tape between said thermal printing head and said platen roller when said tape depressing mechanism is turned to separate said platen roller from said thermal printing head unit, and said tape depressing mechanism being engaged with and fixed to said thermal printing head unit supporting shaft by said engaging means when said platen roller is urged toward said thermal printing head to press a label type to said thermal printing head;

said engaging means comprising a pair of engaging parts on said supporting shaft of said thermal printing head unit respectively positioned on both sides of said thermal printing head and a pair of engaging cutaway parts provided on the support frame of said tape depressing mechanism respectively opposed to said engaging parts, each of said engaging parts having a cross section of a partly cutaway circle which is made up by partly cutting off a true circle with the center on the axial line of said supporting shaft, and said engaging cutaway parts respectively having a straight passage which is open at an end opposed to a corresponding engaging part and a circular hole at the other end of said straight passage, the width of said straight passage being slightly larger than the wall thickness of said engaging parts and the diameter of said circular hole being substantially the same as the diameter of said engaging parts, and a knob on said supporting shaft outside said thermal printing head unit for simultaneously rotating each of said engaging parts in corresponding circular holes of said engaging cutaway parts.

2. A desk top type label printer as claimed in claim 1 wherein a cassette accomodating space is provided in the interior of said casing, and further comprising a cassette containing a thermal printing carbon ribbon insertable from said opening into said space, said cassette in the inserted position surrounding said thermal printing head with said carbon ribbon inserted between the thermal printing head and the platen roller.

3. A desk top type label printer as claimed in claim 2 wherein said cassette has a winding reel on which the carbon ribbon is wound and a takeup reel in the cassette for taking up the carbon ribbon after it has passed said thermal printing head, and further single driving means for driving said platen roller and said takeup reel.

4. A desk top type label printer as claimed in claim 1 further comprising an input means for said electric circuit constituted by a set of keyboard switches, and said electric circuit comprises a microprocessor.

5. A desk top type label printer as claimed in claim 4 in which said input means comprises ROM card receiving means in which a ROM cad is freely mountable.

6. A desk top type printer as claimed in claim 4 in which said input means comprises RAM card receiving means in which a RAM card is freely mountable.

7. A desk top type label printer as claimed in claim 1 wherein said tape depressing mechanism has a turnback pin at the label tape ejection side of said platen roller for turning back a carrier strip of a label tape.

8. A desk top type label printer as claimed in claim 7 wherein said electric circuit includes a labeler mode for, when said label tape is used in a mode where the carrier strip thereof is turned back by said turnback pin, after a label from the label tape is stuck onto an article, reversely rotating said platen roller through a predetermined angle to reversely feed the label tape a predetermined small distance.

* * * * *

UNITED STATES PATENT AND TRADEMARK OFFICE

CERTIFICATE OF CORRECTION

PATENT NO. : 5,049,228

DATED : September 17, 1991

INVENTOR(S) : Junichi SATO

It is certified that error appears in the above-identified patent and that said Letters Patent is hereby corrected as shown below:

Column 8, line 8, for "type" read --tape--;

line 52, for "cad" read --card--.

Signed and Sealed this

Thirtieth Day of March, 1993

*Attest:*

STEPHEN G. KUNIN

*Attesting Officer*

*Acting Commissioner of Patents and Trademarks*